United States Patent [19]

Jordan et al.

[11] Patent Number: 4,911,221

[45] Date of Patent: Mar. 27, 1990

[54] PRODUCTION OF BILLET OR TUBE

[75] Inventors: Richard M. Jordan, Hook Norton, England; Olivo G. Sivilotti, Kingston, Canada

[73] Assignee: Alcan International Limited, Montreal, Canada

[21] Appl. No.: 129,842

[22] Filed: Dec. 8, 1987

[30] Foreign Application Priority Data

Dec. 9, 1986 [GB] United Kingdom ..... 8629373

[51] Int. Cl.[4] ..... B22D 23/00

[52] U.S. Cl. ..... 164/155; 164/46; 164/415; 164/417; 164/421

[58] Field of Search ..... 164/46, 415, 421, 418, 164/448, 442, 484, 150, 154, 155, 413, 449, 417; 264/5, 6, 8, 12; 425/6, 7, 8

[56] References Cited

U.S. PATENT DOCUMENTS 4,114,251 9/1978 Southern et al. ..... 164/46

4,697,631 10/1987 Bungeroth et al. ..... 164/46

*Primary Examiner*—Richard K. Seidel

*Attorney, Agent, or Firm*—Cooper & Dunham

[57] ABSTRACT

The invention provides apparatus for the production of a continuous uniform length of coherent metal. A cone 10 of atomized metal particles is deposited on a surface 12, which is continuously withdrawn in the form of a length of coherent metal 14. Shaping means 16 are provided to make the withdrawn deposit uniform along its length. The equipment is protected from the atmosphere by a hood 18 through which the length of metal is withdrawn through an aperture provided with a seal 20. Preferably, the deposit is of circular cross-section and is caused to rotate during withdrawal about its longitudinal axis. The equipment is suitable to form billet or rod or tube.

8 Claims, 3 Drawing Sheets

PRODUCTION OF BILLET OR TUBE

This invention concerns apparatus for the production of a continuous uniform length of metal by spray-casting and compacting techniques.

British Patent Specification No. 1472939 is one of a family of patents which describe the manufacture from liquid metal of a coherent substantially non-porous preform, by the steps of atomising a stream of molten metal to form a spray of hot metal particles by subjecting the stream of molten metal to high velocity relatively cold gas directed at the stream, and directing the spray of particles at a substrate. The temperature and flow rate of the gas may be determined so as to extract a critical and controlled amount of heat from the atomised metal particles both during flight and on deposition, whereby the solidification of the preform is not dependent on the temperature and/or thermal properties of the substrate. The method, which requires a substrate in the form of a surface or mould, is adapted for batch operation only.

British Patent Specification No. 1359486 describes a method of forming a composite metal strip by providing a molten stream of at least two metals, atomising the stream to form a spray of molten particles and depositing the metal particles onto a backing layer which is traversed beneath the metal spray. Although the method is adapted for continuous operation, a backing layer is required and the product is a laminate of the backing layer with a layer of the deposited metal particles.

U.S. Pat. No. 2,639,490 describes apparatus in which a spray of molten metal is deposited as a layer on a backing strip which is caused to move past the deposit station. The layer is afterwards rolled and separated from the backing strip. The whole operation is performed under vacuum.

U.S. Pat. No. 4,114,251 describes apparatus in which molten metal spray droplets are applied to the surface of a loose bed of the particles which is afterwards compacted to form an elongated body. The operation may be carried out under inert gas in a chamber, with the elongated metal body being withdrawn through an aperture in the chamber wall.

European patent application No. 188994 describes a system for forming a continuous length of unsupported coherent metal by spraying deposition. Where required, control over the external surface of the deposit is achieved by spraying the molten metal particles into an open ended mould or cannister. But technical problems are involved in spraying molten metal droplets onto a deposit in an open ended mould or cannister against which the deposit must be slideable.

The present invention provides apparatus for the production of a continuous uniform length of coherent metal, which apparatus comprises a spray deposit station including a surface, means for holding a supply of molten metal and providing a stream thereof, means for atomising the stream to form a spray of metal particles and for causing the metal particles to form a coherent deposit on the surface, means for continuously withdrawing the deposit from the spray deposit station in the form of a length of coherent metal, shaping means for shaping the withdrawn deposit to make it uniform along its length, and means for shrouding the apparatus to exclude air.

The withdrawn deposit consists of coherent metal formed by spray deposition and compacting techniques.

Except at start-up, no substrate or backing layer is withdrawn with the metal deposit. Although other cross-sections are possible, the uniform length of coherent metal is preferably of circular or annular cross-section. This may take the form of a billet or rod or wire, depending on cross-section, or alternatively of a tube, of the coherent metal. The surface of a deposit formed from metal spray is necessarily somewhat rough and corrugated. The invention provides means for flattening out the original rough or corrugated surface to a smooth finish of the required cross-section while maintaining the deposit in a controlled atmosphere. The shaping means which are designed to achieve this flattening may comprise conventional equipment for grinding, machining, swaging or rolling metal. Preferably, the shaping means comprise three rolls positioned at 120° to each other in a plane perpendicular to the longitudinal axis of the withdrawn deposit, the rolls being shaped to impart a circular (or annular) crosssection to the deposit. The rolls preferably also include means for causing the withdrawn deposit to rotate about its longitudinal axis. This rotation helps to assure uniform deposition of metal particles on the surface at the spray deposit station.

Although the nature of the molten metal to be processed by the apparatus is not critical, the invention is of particular advantage for metals such as aluminium which are readily attacked by oxygen in the finely divided state. Spray casting techniques are useful for forming co-deposits of two different metals which are not miscible in the molten state, or for incorporating fine dispersed refractory, e.g. ceramic, particles in a metal matrix, both these features being contemplated within the scope of the invention. Thus, metal particles may comprise two immiscible metal and/or fine refractory particles. Spray casting conditions are not critical, and may be as described in the family of patents of which GB No. 1472939 is a member. The atomising conditions are preferably such that the metal particles are still liquid on impact, so that the deposit is substantially non-porous, but solidify immediately on impact, so that a pool of molten metal does not build up on the deposit.

The deposit is withdrawn along its longitudinal axis. Atomisation of a stream of molten metal results in a spray cone about another axis. It is preferred that the angle between these two axes be in the region 30° to 40°. By this means, the metal particles are caused to deposit on the end or head of the preform, thus increasing its length in a longitudinal directing and also on the circumference thereof, so increasing its cross-section. In the particular case where it is desired to produce a tube of the coherent metal, there may be provided at the spray deposit station a mandrel to act as the surface to receive the coherent deposit, there being provided also means for causing the mandrel to rotate at the same rate and about the same longitudinal axis as the deposit.

There are preferably provided detection means for detecting the shape of the deposit, both in respect of its head and of its cross-section. These means may be programmed to detect the difference in the shape of the deposit from that desired, and the metal spraying equipment may be made responsive to a signal from the detection means to alter the shape of the deposit. The shaping means may also be made responsive to a signal from the detection means, to correct the cross-sectional shape of the withdrawn deposit.

Means for shrouding the apparatus to exclude air may be a hood surrounding the apparatus and means for introducing an inert gas into the hood. The hood needs to include an aperture for the continuous removal of the length of coherent metal, provided with a seal to prevent the ingress of air into the hood. Complete closure of the apparatus and exclusion of atmospheric oxygen are essential. The invention is not concerned with for example inert gas curtains, which provide only incomplete or unreliable exclusion of atmosphere. A major reason for shaping the deposit is to provide a smooth surface, so as to permit it to be withdrawn through the seal without letting air in. To cope with lengths of metal of different cross-section, the aperture may be provided with an iris-type diaphragm. If it is desired to leave a gap between the diaphragm and the length of metal, so as to avoid scratching the surface of the metal, a multiple diaphragm system may be used with inert gas fed into the gaps between the diaphragms. Also the pressure inside the hood may be maintained slightly above atmospheric, so that loss of inert gas occurs rather than entry of air.

Equipment outside the hood for handling the withdrawn length of metal can be conventional. Two sets of support saddles may be required to maintain constant the axis of rotation of the product so that a straight billet is produced. Equipment may be provided to cut the continuous length of metal into discrete lengths. Or equipment may be provided to wind the continuous length up for storage. In this connection, since the withdrawn deposit is being rotated, winding equipment needs to be specified in inverse relation to the conventional two commonly used systems. For example, when the product requires twisting, laying reels may be used, while when no twist is required, a set of reels of the pouring type should be used.

The invention will be further described with reference to the accompanying drawings in which.

Figure 1:
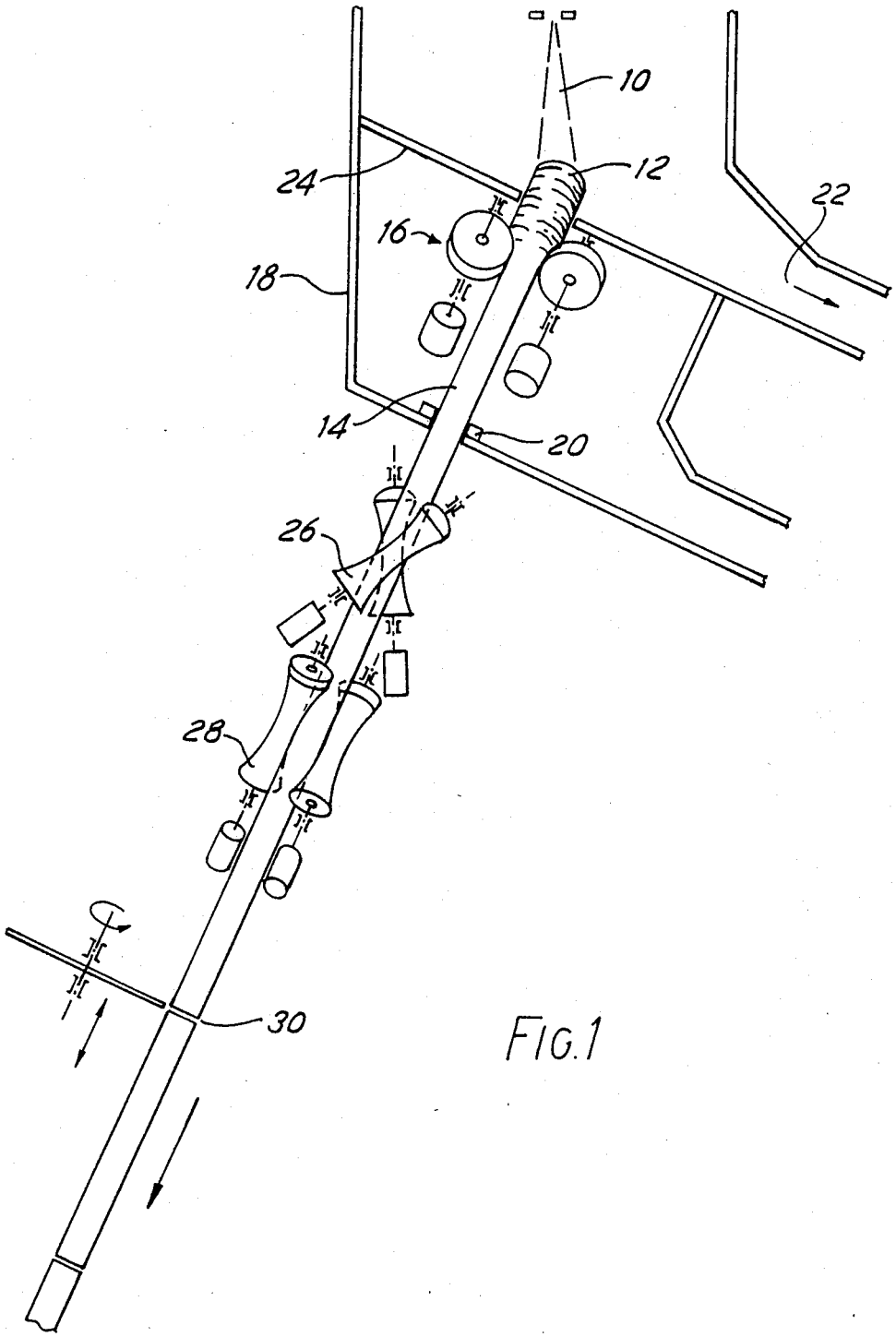
FIG. 1 is a partial schematic plan view of apparatus according to the invention.

Referring to FIG. 1, metal spraying equipment is indicated by a cone 10 of atomised metal particles which are shown as being deposited on a surface 12 at a spray deposit station. The deposit is being continuously withdrawn from the spray deposit station in the form of a length of coherent metal 14. Shaping means 16 in the form of a roll stand for hot sizing are provided to make the withdrawn deposit uniform along its length. The metal spray equipment, spray deposit station and roll stand are all protected from the atmosphere by a hood 18, through which the length of metal is withdrawn through an aperture provided with a seal 20. Within the hood, a duct 22 is provided to extract inert gas and overspray metal particles, and a metal shield 24 protects the roll stand from overspray. This shield may be maintained at a high temperature in the area of potential overspray so that it will be maintained free of build-up. The purpose of the shield is to maintain continuity of operation and prevent damage to the surface of the preform by scratching it or by accidental and uncontrolled falling of metal particles onto it.

Downstream of the exit aperture, the withdrawn deposit enters the atmosphere and encounters conventional equipment. Two sets of support saddles 26, 28 maintain constant the axis of rotation of the product so that straight billet is produced. The saddles function to maintain the billet diameter constant, and perhaps contribute to the smoothness of the surface by means of a hyperbolic roll shape. The angle of skew and the rate of rotation of the saddle rolls need to be controlled in conjunction with the roll stand 16. Further downstream at 30 is a station at which the continuous length of metal is cut up into discrete lengths.

Figure 2:
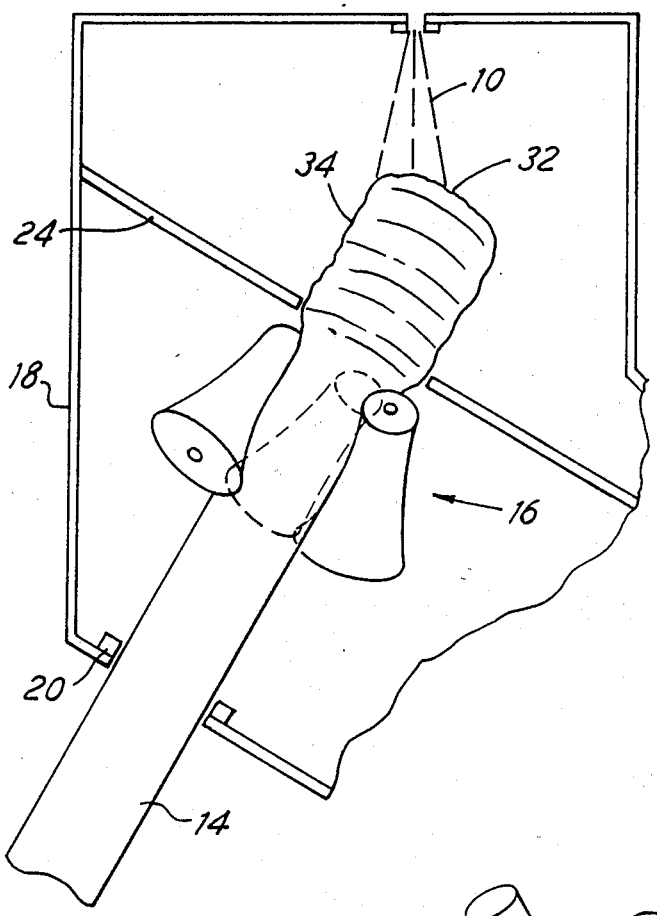
FIG. 2 is an enlarged view of the spray deposit station and shaping means.

As seen in more detail in FIG. 2, the cone of atomised metal particles 10 is positioned at an angle of 35° to the longitudinal axis of the preform. Metal is deposited both on the head 32 of the preform, where the rate of deposition needs to equal the rate of withdrawal; and on the circumference 34, where the rate of deposition needs to be sufficient to build up the desired cross-section. A head and diameter sensor (not shown) monitors the rates of deposition at 32 and 34 and adjusts the metal spray conditions and the operation of the sizing unit 16 as necessary.

Figure 3:
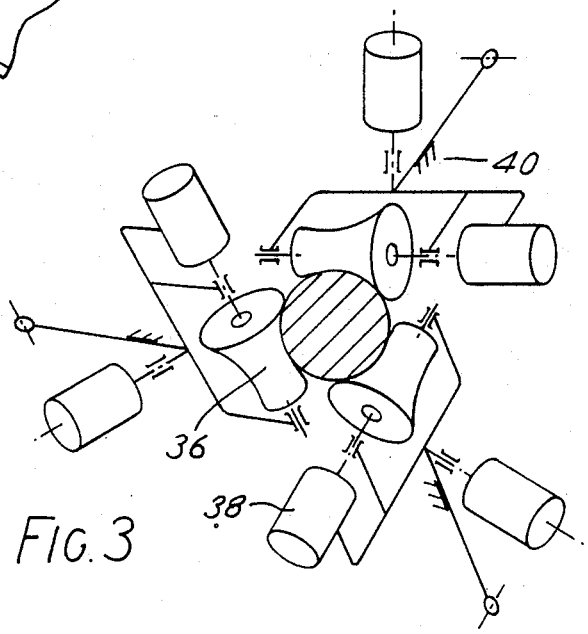
FIG. 3 is a diagrammatic view, in the direction of the longitudinal axis of the withdrawn deposit, of the shaping means.

As seen in FIG. 3, the sizing unit is a rolling stand where three rolls 36, positioned at 120° to each other and in the same plane perpendicular to the axis of the preform, are rotated to impose the desired rate of rotation to the preform, by means of a drive 38 connected axially to each roll neck. For example, the drive for each of the three rolls may be a hydraulic motor, with the flow rate on each motor controlled to achieve the desired rate of rotation. Alternatively, the drive can be an electrical system.

The rolls can be installed in a strong housing (not shown) and positioned to be tangent to the cylinder surface that is describing the outer diameter of the desired billet. A set of screwdowns 40 can be provided to move the roll positions when a different setting is desired to achieve a billet of a different specification. The three screwdowns can be synchronized by an electrical control system (not shown), to simultaneously move the rolls the same distance towards or away from the axis of rotation of the preform. Alternatively the screwdowns could be mechanically linked by a common device which, by rotation round the axis of the preform, introduces a radial motion to the position of the three rolls simultaneously. In both systems, the longitudinal axis of the preform remains unchanged. Therefore the position of the surface of the preform remains unchanged during steady operation, and only changes in response to the control system, initiated by the head and diameter sensor that links the spraying rate to the rate of extraction of the preform.

The rate of extraction of the product is normally the same as the axial movement of the preform exiting the roll stand. To achieve a controlled rate of extraction, the three rolls 36 can be positioned at a skew angle controlled to impart both rotation and longitudinal movement to the preform. This angle can simply be altered in response to an error signal from the head and diameter sensor, so that the desired amount of rolling is continued throughout the process and the metallurgical properties of the product can be controlled and optimised.

Start-up can be simply achieved by threading a starting billet through the two saddles 26, 28 past the seal 20 and the roll stand 16 to the spray deposit station 12. The starting billet may have a dummy preform attached to its tip so that the process can be optimised at start-up. The dummy preform may be in the form of an insulated shape or empty can to cater for the initial transition from cold to hot conditions. Also an empty can is easy to deform in the roll stand even if there is excess sprayed metal on top of it.

Figure 4:
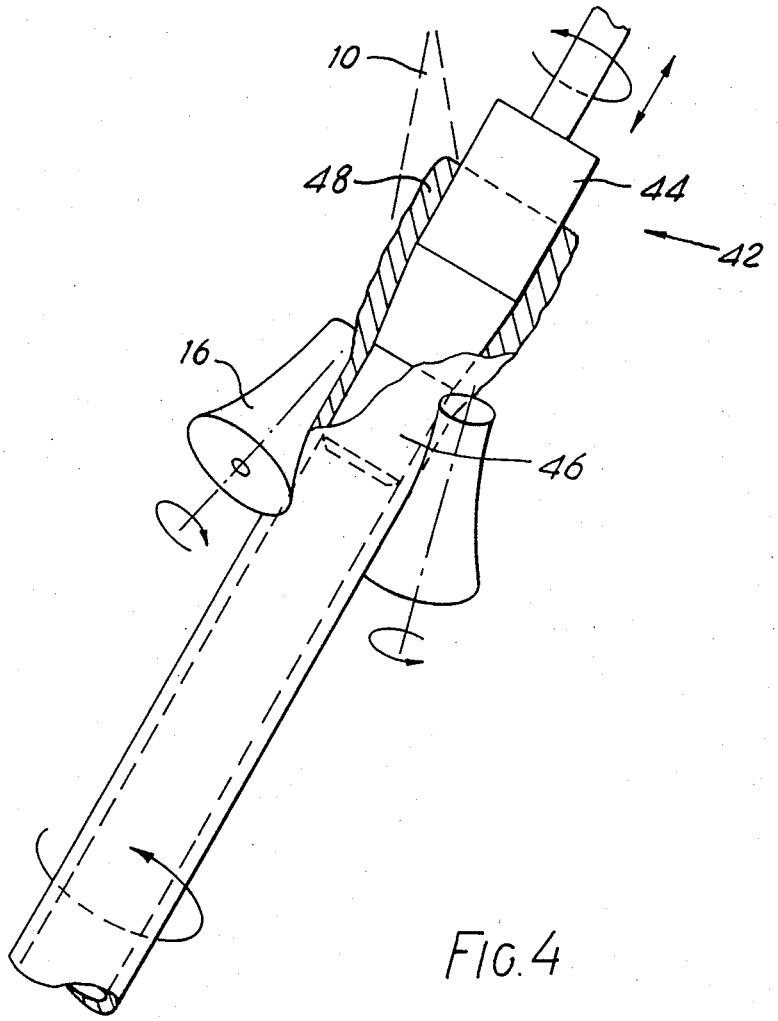
FIG. 4 is a view similar to that of FIG. 2 showing a modification of the apparatus for producing a tube.

FIG. 4 is a partial view of a modification of the apparatus adapted to produce continuous tubing. A generally cylindrical mandrel 42 is provided having a larger diameter section 44 at the spray deposit station at its upstream end, and a somewhat smaller diameter section 46 at its downstream end adjacent the sizing roll stand 16.

In operation, the mandrel is caused to rotate about its axis at the same rate as the preform to be withdrawn. A spray cone 10 comprises atomised metal particles which are deposited at 48 on the surface of the mandrel and accumulate to a predetermined thickness. The deposit is withdrawn in the direction of its longitudinal axis and slides over the surface of the mandrel. As the preform moves axially towards the rolling stand, a gap develops between the hot metal and the mandrel, owing to the reduction in diameter of the mandrel. This helps in reducing stresses in the preform and in cooling the mandrel, and permits lubrication of the inside surface of the preform before it enters the roll stand. To prevent sticking of the metal sprayed onto the mandrel, it may be desired to provide forced lubrication over this area of the mandrel surface. Also, it may be helpful to reciprocate the mandrel in an axial direction, in order to encourage uniform deposition of metal particles. After being subjected to the roll stand 16, the tubular preform 50 is withdrawn in a longitudinal direction and subjected to further treatment as shown in FIG. 1.

We claim:

1. Apparatus for the production of a continuous uniform length of coherent metal, which apparatus comprises a spray deposit station including a surface, means for holding a supply of molten metal and providing a stream thereof, means for atomising the stream to form a spray of metal particles and for causing the metal particles to form a coherent deposit on the surface, means for continuously withdrawing the deposit from the spray deposit station in the form of a length of coherent metal of generally circular or annular cross-section, having a rough or corrugated surface, shaping means for flattening out the said rough or corrugated surface of the withdrawn deposit to make it uniform along its length, and means for shrouding the apparatus to exclude air including an aperture for the continuous removal of the uniform length of coherent metal provided with a seal to prevent the ingress of air, said shaping means being effective to provide a smooth surface on the deposit so as to permit it to be withdrawn through the seal without letting air in.

2. Apparatus as claimed in claim 1, wherein the shaping means include means for causing the withdrawn deposit to rotate about its longitudinal axis.

3. Apparatus as claimed in claim 2, adapted to produce a tube of the coherent metal, wherein there is provided at the spray deposit station a mandrel to act as the surface to receive the coherent deposit, there being provided also means for causing the mandrel to rotate at the same rate and about the same axis as the deposit.

4. Apparatus as claimed in claim 1, adapted to produce a billet or rod of the coherent metal.

5. Apparatus as claimed in claim 1, wherein there is also present detection means for detecting the shape of the deposit.

6. Apparatus as claimed in claim 5, wherein the detection means are programmed to detect a difference in the shape of the deposit from that desired, and the means for forming a spray of metal particles and depositing them on the surface is made responsive to a signal from the detection means to alter the shape of the deposit.

7. Apparatus as claimed in claim 1, wherein the shaping means comprise three rolls positioned at 120° to each other in a plane perpendicular to the longitudinal axis of the withdrawn deposit.

8. Apparatus as claimed in claim 1, wherein the means for shrouding the apparatus are a hood surrounding the apparatus and means for introducing an inert gas into the hood.

* * * * *